US006288012B1

(12) United States Patent
Li et al.

(10) Patent No.: US 6,288,012 B1
(45) Date of Patent: Sep. 11, 2001

(54) CONTAINER, SUCH AS A BEVERAGE CONTAINER, LUBRICATED WITH A SUBSTANTIALLY NON-AQUEOUS LUBRICANT

(75) Inventors: Minyu Li, Oakdale; Keith Darrell Lokkesmoe, Savage; Guang-Jong Jason Wei, Mendota Heights, all of MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 09/441,881

(22) Filed: Nov. 17, 1999

(51) Int. Cl.[7] ..... C10M 125/02; C10M 139/02

(52) U.S. Cl. ..... 508/113; 508/126; 508/181; 508/182; 508/183; 508/208; 508/215

(58) Field of Search ..... 508/113, 126, 508/182, 181, 183, 208, 215

(56) References Cited

U.S. PATENT DOCUMENTS

| | | | | |
|---|---|---|---|---|
| 3,011,975 | * | 12/1961 | Nitzsche et al. | 508/126 |
| 3,664,956 | * | 5/1972 | Messina et al. | 508/183 |
| 3,876,410 | * | 4/1975 | Scholes | 508/485 |
| 3,981,812 | * | 9/1976 | Zletz | 508/215 |
| 4,324,671 | * | 4/1982 | Christian et al. | 508/183 |
| 4,828,727 | * | 5/1989 | McAninch | 585/3 |
| 4,929,375 | * | 5/1990 | Rossio et al. . | |
| 5,009,801 | | 4/1991 | Wider et al. . | |
| 5,073,280 | | 12/1991 | Rossio et al. . | |
| 5,160,646 | * | 11/1992 | Scheld | 508/183 |
| 5,191,779 | * | 3/1993 | Imazu et al. | 72/42 |
| 5,334,322 | * | 8/1994 | Williams, Jr. | 508/579 |
| 5,672,401 | * | 9/1997 | Anglin et al. | 428/64.1 |
| 5,869,436 | | 2/1999 | Lindman . | |

FOREIGN PATENT DOCUMENTS

| | | | |
|---|---|---|---|
| 1157456 A | * | 11/1983 | (CA) . |
| 1564128 | | 10/1976 | (GB) . |
| 57003892A | * | 1/1982 | (JP) . |
| 6136377 | | 5/1994 | (JP) . |
| 10053679A | * | 8/1996 | (JP) . |

OTHER PUBLICATIONS

The Alternative to Soap and Water for Lubricating Conveyor Lines, Jan. 1998, Food and Drink Business, pp. 35–36.
Lubrication and Lubricants Encyclopedia of Chemical Technology, vol. 15 pp. 463–517.

* cited by examiner

*Primary Examiner*—Jacqueline V. Howard
(74) *Attorney, Agent, or Firm*—Shanks & Herbert

(57) ABSTRACT

A process for lubrication a container, such as a beverage container, by applying to the container, a substantially non-aqueous lubricant. The process provides many advantages as compared to the use of an aqueous lubricant.

39 Claims, No Drawings

CONTAINER, SUCH AS A BEVERAGE CONTAINER, LUBRICATED WITH A SUBSTANTIALLY NON-AQUEOUS LUBRICANT

BACKGROUND OF THE INVENTION

1. Field of the Invention

The present invention relates to substantially non-aqueous lubricants and lubricant compositions, and to their use, for example, to treat or lubricate containers and conveyor systems for containers. The invention also relates to containers and conveyor systems treated with a substantially non-aqueous lubricant or lubricant composition. The container is, for example, a food or beverage container.

2. Description of Related Art

Containers are receptacles in which materials are or will be held or carried. Containers are commonly used in the food or beverage industry to hold food or beverages. Often lubricants are used in conveying systems for containers, to ensure the appropriate movement of containers on the conveyor.

In the commercial distribution of many products, including most beverages, the products are packaged in containers of varying sizes. The containers can be in the form of cartons, cans, bottles, Tetra Pak packages, waxed carton packs, and other forms of containers. In most packaging operations, the containers are moved along conveying systems, usually in an upright positions, with the opening of the container facing vertically up or down. The containers are moved from station to station, where various operations, such as filling, capping, labeling, sealing, and the like, are performed.

Containers, in addition to their many possible formats and constructions, may comprise many different types of materials, such as metals, glasses, ceramics, papers, treated papers, waxed papers, composites, layered structures, and polymeric materials. Any desired polymeric materials can be used, such as polyolefins, including polyethylene, polypropylene, polystyrene, and mixtures thereof, polyesters such as polyethylene terephthalate and polyethylene naphthalate (PEN) and mixtures thereof, polyamides, polycarbonates, and the like.

Lubricating solutions are often used on conveying systems during the filling of containers, for example, with beverages. There are a number of different requirements that are desirable for such lubricants. For example, the lubricant should provide an acceptable level of lubricity for the system. It is also desirable that the lubricant have a viscosity which allows it to be applied by conventional pumping and/or application apparatus, such as by spraying, roll coating, wet bed coating, and the like, commonly used in the industry.

In the beverage industry, it is also important that the lubricant is compatible with the beverage so that it does not form solid deposits when it accidentally contacts spilled beverages on the conveyor system. This is important since the formation of deposits on the conveyor system may change the lubricity of the system and could require shutdown of the equipment to facilitate cleaning.

It is also important that the lubricant can be cleaned easily. The container and/or the conveyor system may need to be cleaned. Since water is often in the cleaning solution, ideally the lubricant has some water soluble properties.

Currently, containers, including polyethylene terephthalate (PET) bottles, and/or the conveying system are often coated with an aqueous-based lubricant to provide lubricity to the container so that it can more easily travel down a conveyor system. Many currently used aqueous-based lubricants are disadvantageous because they are incompatible with many beverage containers, such as PET and other polyalkylene terephthalate containers, and may lead to stress cracking of the PET bottles. Furthermore, aqueous based lubricants are in general often disadvantageous because of the large amounts of water used, the need to use a wet work environment, the increased microbial growth associated with such water-based system, and their high coefficient of friction. Moreover, most aqueous-based lubricants are incompatible with beverages.

SUMMARY OF THE INVENTION

Therefore, it was an object of the present invention to provide an alternative to aqueous-based lubricants currently used in the container industry, which overcomes one or more of the disadvantages of currently used aqueous-based lubricants. It was also an object of the invention to provide methods of lubricating containers, such as beverage containers, that overcome one or more of the disadvantages of current methods.

In accordance with the objectives, there has been provided in accordance with the present invention, a container or conveyor for a container whose surface is coated at least in part with a substantially non-aqueous lubricant or substantially non-aqueous lubricant composition.

There is also provided in accordance with the invention, a process for lubricating a container, comprising applying to a surface of the container a substantially non-aqueous lubricant or lubricant composition.

There is also provided in accordance with the invention, a process for lubricating a conveyor system used to transport containers, comprising applying a substantially non-aqueous lubricant or lubricant composition to the conveying surface of a conveyor, and then moving containers, such as beverage containers, on the conveyor.

There is also provided a process comprising moving beverage containers on a conveyor that has been lubricated with a substantially non-aqueous lubricant or lubricant composition.

There is also provided in accordance with the invention, a conveyor used to transport containers, which is coated on the portions that contact the container with a substantially non-aqueous lubricant or lubricant composition.

There is also provided a composition for preventing or inhibiting the growth of microorganisms on a container or a conveyor surface for a container, comprising a substantially non-aqueous lubricant and an antimicrobial agent.

There is also provided a substantially non-aqueous lubricant and a substantially non-aqueous lubricant composition, and process for cleaning the lubricant or lubricant composition from the container and conveyor system.

Further objects, features, and advantages of the invention will become apparent from the detailed description that follows.

DETAILED DESCRIPTION OF PREFERRED EMBODIMENTS

The present invention uses a substantially non-aqueous lubricant to lubricate containers and/or conveyor systems upon which the containers travel. Substantially non-aqueous means the lubricant is non-aqueous or includes water only as an impurity, or includes an amount of water that does not significantly and adversely affect the stability and lubricating properties of the composition, for example, less than 10%, or less than 5%, or less than 1% by weight of water based on the weight of the lubricant.

The invention also relates to lubricant compositions containing such a substantially non-aqueous lubricant. The compositions also are preferably substantially non-aqueous as defined above. That is, the total amount of water in the composition is generally less than 10% or less than 5% or less than 1% by weight, based on the total weight of the lubricant composition. The lubricant composition of the invention contains an amount of the substantially non-aqueous lubricant to provide desired lubrication properties. Generally, this amount ranges from about 50 to about 100, for example, from about 80 to about 98 weight percent, based on the total weight of the lubricant composition.

Any desired substantially non-aqueous lubricant may be used that is effective in lubricating the system. For example, the lubricant can include natural lubricants, petroleum lubricants, synthetic oils, greases and solid lubricants. Examples of natural lubricants include vegetable oils, fatty oils, animal fats, and others that are obtained from seeds, plants, fruits, and animal tissue. Examples of petroleum lubricants include mineral oils with various viscosities, petroleum distillates, and petroleum products. Examples of synthetic oils include synthetic hydrocarbons, organic esters, poly(alkylene glycol)s, high molecular weight alcohols, carboxylic acids, phosphate esters, perfluoroalkylpolyethers (PFPE), silicates, silicones such as silicone surfactants, chlorotrifluoroethylene, polyphenyl ethers, polyethylene glycols, oxypolyethylene glycols, copolymers of ethylene and propylene oxide, and the like.

Examples of useful solid lubricants include molybdenum disulfide, boron nitride, graphite, silica particles, silicone gums and particles, polytetrafluoroethylene (PTFE, Teflon), fluoroethylene-propylene copolymers (FEP), perfluoroalkoxy resins (PFA), ethylene-chloro-trifluoroethylene alternating copolymers (ECTFE), poly (vinylidiene fluoride) (PVDF), and the like.

The lubricant composition can contain from 0 to 100 percent by weight of solid lubricant based on the weight of the lubricant composition. The lubricant composition can contain a solid lubricant as a suspension in a substantially non-aqueous liquid. In such a situation, the amount of solid lubricant can be about 0.1 to 50 weight percent, preferably 0.5 to 20 percent by weight, based on the weight of the composition.

Also, the solid lubricant can be used without a liquid. In such a situation, the amount of solid lubricant can be from about 50 to about 100 weight percent, preferably from about 80 to about 98 percent by weight, based on the weight of the composition.

Specific examples of useful lubricants include oleic acid, corn oil, mineral oils available from Vulcan Oil and Chemical Products sold under the "Bacchus" tradename; fluorinated oils and fluorinated greases, available under the tradename "Krytox" from DuPont Chemicals. Also useful are siloxane fluids available from General Electric silicones, such as SF96–5 and SF 1147 and synthetic oils and their mixture with PTFE available under the tradename "Super Lube" from Synco Chemical. Also, high performance PTFE lubricant products from Shamrock, such as nanoFLON MO20, FluoroSLIP 225 and Neptune 5031 and polyalkylene glycols from Union Carbide such as UCON LB625, and Carbowax materials are useful.

The lubricants can be water-soluble or water-dispersible. In such cases, the lubricant can be easily removed from the container, if desired, by, for example, treatment with water. The lubricant, whether water-soluble or dispersible or not, is preferably easily removable from the container, conveyor and/or other surfaces in the vicinity, with common or modified detergents, for example, including one or more of surfactants, an alkalinity source, and water-conditioning agents. Useful water-soluble or dispersible lubricants include, but are not limited to, polymers of one or more of ethylene oxide, propylene oxide, methoxy polyethylene glycol, or an oxyethylene alcohol.

Preferably the lubricant is compatible with the beverage intended to be filled into the container.

While many substantially non-aqueous lubricants are known per se, they have not been previously known or suggested to be used in the container or beverage container industries as described in this application.

In certain embodiments, it is preferred that the lubricant is other than a (i) organic polymer, or other than a (ii) fluorine-containing polymer, or other than (iii) PTFE. In these embodiments, if (i), (ii) or (iii) is desired to be used, it can be used in combination with another lubricant.

The substantially non-aqueous lubricant used in the present invention can be a single component or a blend of materials from the same or different type of class of lubricant. Any desired ratio of the lubricants can be used so long as the desired lubricity is achieved. The lubricants can be in the form of a fluid, solid, or mixture of two or more miscible or non-miscible components such as solid particles dispersed in a liquid phase.

Also, a multistep process of lubricating can be used. For example, a first stage of treating the container and/or conveyor with a substantially non-aqueous lubricant and a second stage of treating with another lubricant, such as a substantially non-aqueous lubricant or an aqueous lubricant can be used. Any desired aqueous lubricant can be used, such as water. Any desired substantially non-aqueous lubricant can be used in the first or second stage. The lubricant of the second stage can be solid or liquid. By selection of appropriate first and second stages, desired lubrication can be provided. Also, the order of the second stage and first stage can be switched to give desired lubrication.

In addition to the lubricant, other components can be included with the lubricant to provide desired properties. For example, antimicrobial agents, colorants, foam inhibitors or foam generators, PET stress cracking inhibitors, viscosity modifiers, friction modifiers, antiwear agents, oxidation inhibitors, rust inhibitors, extreme pressure agents, detergents, dispersants, foam inhibitors, film forming materials and/or surfactants can be used, each in amounts effective to provide the desired results.

Examples of useful antiwear agents and extreme pressure agents include zinc dialkyl dithiophosphates, tricresyl phosphate, and alkyl and aryl disulfides and polysulfides. The antiwear and/or extreme pressure agents are used in amounts to give desired results. This amount can be from 0 to about 20 weight percent, preferably about 1 to about 5 weight percent for the individual agents, based on the total weight of the composition.

Examples of useful detergents and dispersants include alkylbenzenesulfonic acid, alkylphenols, carboxylic acids, alkylphosphonic acids and their calcium, sodium and magnesium salts, polybutenylsuccinic acid derivatives, silicone surfactants, fluorosurfactants, and molecules containing polar groups attached to an oil-solubilizing aliphatic hydrocarbon chain. The detergent and/or dispersants are used in an amount to give desired results. This amount can range from 0 to about 30, preferably about 0.5 to about 20 percent by weight for the individual component, based on the total weight of the composition.

Useful antimicrobial agents include disinfectants, antiseptics and preservatives. Non-limiting examples of useful antimicrobial agents include phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, methyl p-hydroxy benzoic acid, cationic agents such as quaternary ammonium compound, aldehydes such as glutaraldehyde, antimicrobial dyes such as acridines, triphenylmethane dyes and quinones and halogens including iodine and chlorine compounds. The antimicrobial agents is used in amount to provide desired antimicrobial properties. For example, from 0 to about 20 weight percent, preferably about 0.5 to about 10 weight percent of antimicrobial agent, based on the total weight of the composition can be used.

Examples of useful foam inhibitors include methyl silicone polymers. Non-limiting examples of useful foam generators include surfactants such as non-ionic, anionic, cationic and amphoteric compounds. These components can be used in amounts to give the desired results.

Viscosity modifiers include pour-point depressants and viscosity improvers such as polymethacrylates, polyisobutylenes and polyalkyl styrenes. The viscosity modifier is used in amount to give desired results, for example, from 0 to about 30 weight percent, preferably about 0.5 to about 15 weight percent, based on the total weight of the composition.

A layer of solid lubricant can be formed as desired, for example, by curing or solvent casting. Also, the layer can be formed as a film or coating or fine powder on the container and/or conveyor, without the need for any curing.

The lubricant can be used to treat any type of container, including those mentioned in the Background section of this application. For example, glass or plastic containers, including polyethylene terephthalate containers, polymer laminates, and metal containers, such as aluminum cans, papers, treated papers, coated papers, polymer laminates, ceramics, and composites can be treated.

By container is meant any receptacle in which material is or will be held or carried. For example, beverage or food containers are commonly used containers. Beverages include any liquid suitable for drinking, for example, fruit juices, soft drinks, water, milk, wine, artificially sweetened drinks, sports drinks, and the like.

The lubricant should generally be non-toxic and biologically acceptable, especially when used with food or beverage containers.

The present invention is advantageous as compared to prior aqueous lubricants because the substantially non-aqueous lubricants have good compatibility with PET, superior lubricity, low cost because large amounts of water are not used, and allow for the use of a dry working environment. Moreover, the present invention reduces the amount of microbial contamination in the working environment, because microbes generally grow much faster in aqueous environments, such as those from commonly used aqueous lubricants.

The lubricant can be applied to a conveyor system surface that comes into contact with containers, the container surface that needs lubricity, or both. The surface of the conveyor that supports the containers may comprise fabric, metal, plastic, elastomer, composites, or mixture of these materials. Any type of conveyor system used in the container field can be treated according to the present invention.

The lubricant can be applied in any desired manner, for example, by spraying, wiping, rolling, brushing, or a combination of any of these, to the conveyor surface and/or the container surface. The lubricant can also be applied by vapor deposition of lubricant, or by atomizing or vaporizing the lubricant to form fine droplets that are allowed to settle on the container and/or conveyor surface.

If the container surface is coated, it is only necessary to coat the surfaces that come into contact with the conveyor, and/or that come into contact with other containers. Similarly, only portions of the conveyor that contacts the containers need to be treated. The lubricant can be a permanent coating that remains on the containers throughout its useful life, or a semi-permanent coating that is not present on the final container.

EXAMPLES

The invention can be better understood by the following examples. The examples are for illustration purposes only, and do not limit the scope of the invention.

In the examples, lubricity was measured as follows:

Lubricity Test Procedure

Lubricity test was done by measuring the drag force (frictional force) of a weighted cylinder riding on a rotating disc, wetted by the testing sample. The material for the cylinder is chosen to coincide with the container materials, e.g., glass, PET, or aluminum. Similarly the material for the rotating disc is the same as the conveyor, e.g., stainless steel or plastics. The drag force, using an average value, is measured with a solid state transducer, which is connected, to the cylinder by a thin flexible string. The weight of the cylinder made from the same material is consistent for all the measurements.

The relative coefficient of friction (Rel COF) was then calculated and used, where: Rel COF=COF(sample)/COF (reference)=drag force (sample)/drag force (reference).

Two commercially available aqueous-based lubricants for beverage conveyors were used as reference at recommended use dosage. They are reference 1 =LUBODRIVE RX and reference 2=Lubri-Klenz LF, both are manufactured by Ecolab.

A Rel COF lower than 1 indicates a better lubricant than the reference. A good lubricant would have a typical Rel COF of less than 1.2, while a value greater than 1.4 would indicate a poor lubricant.

The lubricity results of some non-aqueous based lubricants were tested and are shown below. The lubricity measurement was carried out with the method described above. All the tests were using 100% of the stated materials or as indicated. The materials were either added or wiped onto the disc surface to result in a continuous film. The references were aqueous based lubricants and tested at 0.1% of conc. by weight in water for comparison. The test was run for several minutes until the force leveled off. The average drag force was recorded and the Rel COF was calculated based on the average drag forces of the testing sample and the reference.

Examples 1–3

These examples demonstrated that corn oil, a natural oil, possesses lubricities which are better than or comparable to a commercially available aqueous based lube.

The cylinder material was mild steel for Example 1, glass for Example 2, and PET for Example 3. The rotating disk was stainless steel for Examples 1–3.

| | EXAMPLE 1 Mild steel-on stainless steel lubricity | | EXAMPLE 2 Glass-on stainless steel lubricity | | EXAMPLE 3 PET-on stainless steel lubricity | |
|---|---|---|---|---|---|---|
| | Corn oil | Refer. 1 | Corn oil | Refer. 1 | Corn oil | Refer. 1 |
| Drag force (average) (g) | 21.0 | 35.1 | 25.3 | 26.1 | 25.7 | 36.0 |
| Rel COF | 0.598 | 1.000 | 0.969 | 1.000 | 0.714 | 1.000 |

Examples 4–6

These examples demonstrated that Bacchus 22, a mineral oil, possesses lubricities which are better than the commercially available aqueous based lube. The cylinder material was mild steel for Example 4, glass for Example 5, and PET for example 6. The rotating disk was stainless steel for Example 4–6.

| | EXAMPLE 4 Mild steel-on stainless steel lubricity | | EXAMPLE 5 Glass-on stainless steel lubricity | | EXAMPLE 6 PET-on stainless steel lubricity | |
|---|---|---|---|---|---|---|
| | Bacchus 22 | Refer. 1 | Bacchus 22 | Refer. 1 | Bacchus 22 | Refer. 1 |
| Drag force (average) (g) | 10.2 | 31.3 | 22.4 | 27.6 | 18.6 | 31.1 |
| Rel COF | 0.326 | 1.000 | 0.812 | 1.000 | 0.598 | 1.000 |

Examples 7–8

These examples demonstrated that the two synthetic lubricants have a mild steel-on-stainless steel lubricity that is better than or comparable to the commercially available aqueous based lube. The cylinder material was mild steel and the rotating disk was stainless steel.

| | EXAMPLE 7 Krytox GPL 100 | EXAMPLE 8 Krytox GPL 200 | Reference 1 |
|---|---|---|---|
| Drag force (average) (g) | 15.1 | 34.3 | 35.0 |
| Rel COF | 0.431 | 0.980 | 1.000 |

Example 9

This example demonstrated that SF96–5, a synthetic siloxane lubricant, has a PET-on stainless steel lubricity that is better than the commercially available aqueous based lube. The cylinder material was PET and the rotating disk was stainless steel.

| | SF96-5 | Reference 1 |
|---|---|---|
| Drag force (average) (g) | 27.6 | 35.1 |
| Rel COF | 0.786 | 1.000 |

Example 10

This example demonstrated that Krytox DF50, a solid lubricant in a solvent, possesses a mild steel-on stainless steel-lubricity that is comparable to the commercially available aqueous based lube. The cylinder material was mild steel and the rotating disk was stainless steel.

| | Krytox DF50 | Reference 1 |
|---|---|---|
| Drag force (average) (g) | 35.7 | 35.0 |
| Rel COF | 1.020 | 1.000 |

The sample was applied to the disc surface then the coating was wiped with an isopropanol-wetted towel and air dried to result in a very thin, smooth coating.

Examples 11–12

These examples demonstrated that behenic acid, a dry solid lubricant possesses a mild steel-on-stainless steel and glass-on-stainless steel lubricities which are comparable to a second commercially available aqueous based lube.

| | EXAMPLE 11 Mild steel-on stainless steel lubricity | | EXAMPLE 12 Glass-on stainless steel lubricity | |
|---|---|---|---|---|
| | Behenic acid | Reference 2 | Behenic acid | Reference 2 |
| Drag force (average) (g) | 30.0 | 28.0 | 28.0 | 28.0 |
| Rel COF | 1.071 | 1.000 | 1.000 | 1.000 |

0.1% behenic acid in ethanol was applied to the stainless steel rotating disc. A thin dry film was formed after the solvent evaporation.

Example 13

This example demonstrated that the Super lube oil with PTFE possesses a mild steel-on-stainless steel lubricity that is better than the commercially available aqueous based lube. The rotating disk was stainless steel.

| | Super lube oil with PTFE | Reference 1 |
|---|---|---|
| Drag force (average) (g) | 27.9 | 33.2 |
| Rel COF | 0.840 | 1.000 |

Examples 14–15

These examples demonstrated that the mixture of oleic acid and Krytox GPL100 possesses mild steel-on-stainless steel and PET-on-stainless steel lubricities, which are better than the commercially available aqueous based lube. The ratio of oleic acid to Krytox GPL100 is about 1:1 by weight. The rotating disk was stainless steel.

| | EXAMPLE 14 Mild steel-on Stainless steel lubricity | | EXAMPLE 15 PET-on staintess steel lubricity | |
|---|---|---|---|---|
| | Oleic acid/ Krytox GPL 100 (1:1) | Reference 1 | Oleic acid/ Krytox GPL 100 (1:1) | Reference 1 |
| Drag force (average) (g) | 17.1 | 33.7 | 21.4 | 35.7 |
| Rel COF | 0.507 | 1.000 | 0.599 | 1.000 |

Examples 16–17

These examples demonstrate that the mineral oil, Bacchus 68 and its mixture with an antimicrobial agent, Irgasan DP300 (2,4,4'-trichloro-2'-hydroxy-diphenyl-ether, obtained from Ciba Specialty Chemicals) possess a superior PET stress cracking resistance.

PET bottle stress cracking test:

31.0 g of sodium bicarbonate and 31.0 g of citric acid were added to a 2-liter PET bottle (manufactured by Plastipak) containing 1850 g of chilled water and the bottle was capped immediately. The charged bottle was then rinsed with DI water and set on clear paper towel overnight.

Two testing liquids were prepared. Bacchus 68 was used as such as supplied. Bacchus 68+0.2% Irgasan DP300 was made by dissolving 1.0 g of Irgasan DP300 in 500 g of Bacchus 68 to result in a clear solution.

The base of the charged bottle was dipped into the testing liquid for 2–3 seconds then the bottle was placed in a plastic bag. The bottle with the bag was set in a bin and aged at 37.8° C. and 90% humidity for 15 days. Four bottles were used for each testing liquid. The bottle was examined several times during the aging for bursting.

After the aging, the base of the bottle was cut off and examined for crazing and cracking. The results are listed in the table below.

The grading is based on a scale of A–F as:

A: No signs of crazing to infrequent small, shallow crazes.

B: Frequent small, shallow to infrequent medium depth crazes which can be felt with a fingernail.

C: Frequent medium depth to infrequent deep crazes.

D: Frequent deep crazes.

F: Cracks, bottle burst before end of the 15 day testing.

| | PET STRESS CRACKING GRADING | |
|---|---|---|
| Testing Liquid | EXAMPLE 16 Bacchus 68 | EXAMPLE 17 Bacchus 68 + 0.2% Irgasan DP300 |
| Bottle 1 | B | B |
| Bottle 2 | B | B |
| Bottle 3 | B | B |
| Bottle 4 | B | B |

Example 18

This example demonstrates that the mineral oil, Bacchus 68 possesses a higher PET stress cracking resistance in contrast to the aqueous based beverage conveyor lubricant, Lubodrive RX at a possible use dosage for conveyor lubrication.

The experimental procedure was the same as described in example 16–17 except that the testing liquid for Lubrodrive RX was 0.75% by weight in DI water. The charged bottle was placed in the plastic bag that contained 100 g of the diluted Lubodrive RX. Also the experimental was carried out in the environmental oven at 37.8° C. and 90% humidity for 13 days instead of 15 days.

The results showed that Bacchus 68 caused less stress cracking than the Lubodrive RX at 0.75%.

Examples 19–20

Example 19 demonstrates that the mineral oil, Bacchus 68, did not support the microbial growth, but killed the microbial in contrast to the commercially available beverage lube, Dicolube PL, manufactured by Diversey-Lever. Example 20 demonstrates that with the addition of the antimicrobial, methyl Paraben, to the mineral oil, the killing efficiency for the short time exposure was enhanced.

The Rate of Kill Antimicrobial Efficiency Test was carried out according to the method described below:

The bacteria, staphylococus aureus ATCC6538 and enterobacter aerogenes ATCC 13048, were transferred and maintained on nutrient agar slants. Twenty-four hours prior to testing, 10mls of nutrient broth was inoculated with a loopful of each organism, one tube each organism. The inoculated nutrient broth cultures were incubated at 37° C. Shortly before testing, equal volumes of both incubated cultures were mixed and used as the test inoculum.

For Dicolube PL, the lube was diluted to 0.5% wt with soft water. One ml of the inoculunt was combined with 99 mls of the lubricant solution and swirled. For oil-based lube, equal volumes of organisms were centrifuged at 9000 rpm 20° C. for 10 minutes, then decanted and re-suspended in an equivalent volume of the mineral oil.

A one ml sample of the lubricant/inoculum mixture was removed after 5 minute exposure time and added to 9 mls of a sterile DIE neutralizing broth. The neutralized sample was serially diluted with buffered water and plated in duplicate using D/E neutralizing agar. The procedure was repeated after 15 and 60 minutes exposure times. The plates were incubated at 37° C. for 48 hours then examined.

Controls to determined initial inoculum were prepared by adding one ml of inoculum to 9% mls of buffered water, serially diluting the mixture with additional buffered water, and plating with TGE.

The % reduction and log reduction were calculated as:

% Reduction=[(# of initial inoculum−# of survivors)/(#of initial inoculum)]×100 where: # of initial inoculum= $3.4\times10^6$ CFU/ml CFU/ml: Colony forming units/ml Log Reduction=[$\log_{10}$ (initial inoculum CFU/ml)]−[log 10 (survivors inoculum CFU/ml)]

The table showed the results of Rate of Kill Test:

| Test | EXAMPLE 19 Bacchus 68 100% | | | EXAMPLE 20 Bacchus 68 w 0.05% methyl Paraben* 100% | | | COMPARISON EXAMPLE Dicolube PL 0.5% in DI water | | |
|---|---|---|---|---|---|---|---|---|---|
| | No. of | Reduction | | No. of | Reduction | | No. of | Reduction | |
| Concentration Exposure time | survivors CFU/ml | Log | Percent | survivors CFU/ml | Log | Percent | survivors CFU/ml | Log | Percent |
| 5 minutes | $2.4 \times 10^5$ | 1.15 | 92.941 | $8.6 \times 10^4$ | 1.60 | 97.470 | $3.5 \times 10^6$ | NR** | NR |
| 15 minutes | $2.3 \times 10^5$ | 1.17 | 93.235 | $4.3 \times 10^4$ | 1.90 | 98.735 | $3.6 \times 10^6$ | NR | NR |
| 60 minutes | $2.8 \times 10^5$ | 2.08 | 99.176 | $3.2 \times 10^4$ | 2.03 | 99.059 | $3.0 \times 10^6$ | 0.05 | 11.765 |

*Methyl Paraben: methyl 4-hydroxybenzoate, obtained from AVOCADO Research Chemicals Ltd.
**NR: No reduction

Examples 21–22

These examples demonstrate that behenic acid, a dry solid lubricant, in combination with a liquid lubricant provides a mild steel-on-stainless steel and glass-on-stainless steel lubricities which are better than or comparable to the second commercially available aqueous based lube.

| | EXAMPLE 21 Mild steel-on stainless steel lubricity | | EXAMPLE 22 Glass-on stainless steel lubricity | |
|---|---|---|---|---|
| | Behenic acid then $H_2O$ | Reference 2 | Behenic acid then $+H_2O$ | Reference 2 |
| Drag force (average) (g) | 26.0 | 28.0 | 25.0 | 28.0 |
| Rel COF | 0.929 | 1.000 | 0.893 | 1.000 |

0.1% behenic acid in ethanol was applied to the stainless steel disc, a thin dry film was formed after the solvent evaporation. $H_2O$ was then applied to the surface of the dry film coated disc for the lubricity measurement.

The following table describes materials used in the above examples.

| LUBRICANT MATERIAL/TRADE NAME | MATERIAL INFORMATION | VENDOR |
|---|---|---|
| Bacchus 22 | United States Pharmacopeia grade mineral oil | Vulcan Oil & Chemical Products |
| SF96-5 | Polydimethylsiloxane | GE silicones |
| Krytox GPL 100 | Perfluoropolyether | DuPont |
| Krytox GPL 200 | Perfluoropolyether mixed with PTFE (Polytetrafluoroethylene) | DuPont |
| Krytox DF50 | Polytetrafluoroethylene in HCFC-14b | DuPont |
| Super lube oil with PTFE | Synthetic oil with PTFE | Synco Chemical |
| Oleic acid | Oleic acid | Henkel |
| Corn oil | Corn oil | |

It is believed that Applicants'invention includes many other embodiments, which are not herein described, accordingly this disclosure should not be read as being limited to the foregoing examples or preferred embodiments.

What we claim is:

1. A non-aqueous lubricant coating at least a portion of one contact surface of a container or a container conveyor, wherein said lubricant is compatible with both the container and the conveyor and comprises a mixture of a fluorine-containing lubricant and a synthetic oil lubricant, said contact surface comprising a surface of the conveyor that contacts the container or a surface of the container that contacts the conveyor or other containers.

2. A process for lubricating a container or container conveyor, comprising applying to at least a portion of at least one contact surface of the container or conveyor, a substantially non-aqueous lubricant said contact surface comprising a surface of the conveyor that contacts the contacts the container or a surface of the container that contacts the conveyor or other containers, wherein said container is made of metal, ceramic, paper, or polymeric material.

3. A process as claimed in claim 2, wherein the applying comprises coating the portions of the container or the conveyor with the substantially non-aqueous lubricant.

4. A process as claimed in claim 2, wherein the conveyor is coated with the substantially non-aqueous lubricant, whereby the substantially non-aqueous lubricant on the conveyor system is applied to the container while the container is on the conveyor system.

5. A process for lubricating a conveyor used to transport containers, the process comprising applying a substantially non-aqueous lubricant to the conveying surface of a conveyor, and then moving a container on the conveyor.

6. A process according to claim 2, wherein the applying comprises one or more of spraying, wiping, rolling, brushing, vapor deposition, or atomizing.

7. A process according to claim 6, additionally comprising cleaning said conveyor with a cleaning solution to remove the lubricant.

8. A process according to claim 7, wherein said cleaning solution is substantially water.

9. A process according to claim 7, wherein said substantially non-aqueous lubricant comprises a polymer of ethylene oxide, propylene oxide, methoxy polyethylene glycol, and an oxyethylene alcohol.

10. A coated container, or container conveyor having at least one contact surface coated at least in part with a substantially non-aqueous lubricant, said contact surface comprising a surface of the conveyor that contacts the container or a surface of the container that contacts the conveyor or other containers wherein said container is made of metal, ceramic, paper, or polymeric material.

11. A process according to claim 2, further comprising applying a second lubricant to said at least one contact surface of the container or conveyor.

12. A substantially non-aqueous lubricant composition comprising about 50% to 100% by weight based on the total weight of the composition, of a lubricant as claimed in claim.

13. The lubricant of claim 1, wherein said lubricant is non-toxic.

14. The lubricant of claim 1, wherein said lubricant is water-soluble or water-dispersable.

15. The lubricant of claim 1, wherein said lubricant further comprises one or more antimicrobial agents.

16. A process for ensuring the appropriate movement of a container on a container conveyor comprising applying to at least one contact surface a substantially non-aqueous liquid, said contact surface of the comprising a surface of the container that contacts the conveyor or other surface of the conveyor that contacts the container, wherein said container is made of metal, ceramic, paper, or polymeric material.

17. The process of claim 16, wherein said lubricant comprises a natural lubricant obtained from seeds, plants, fruits or animal tissues.

18. The process of claim 16, wherein said lubricant comprises a mineral oil.

19. The process of claim 16, wherein said lubricant comprises a synthetic oil.

20. The process of claim 16, wherein said lubricant comprises a synthetic hydrocarbon.

21. The process of claim 16, wherein said lubricant comprises a polymeric material.

22. The process of claim 16, wherein said lubricant comprises a polymer containing silicone.

23. The process of claim 22, wherein said silicone comprises polydimethyl siloxane, polyalkyl siloxane, and polyphenyl siloxane.

24. The process of claim 16, wherein said lubricant comprises a polymer containing fluorine.

25. The process of claim 24, wherein said fluorine comprises perfluoropolyether or polytetrafluoroethylene.

26. The process of claim 16, wherein said lubricant comprises polyalkylene glycol.

27. The process of claim 16, wherein said lubricant comprises an organic compound.

28. The process of claim 16, wherein said lubricant comprises a phosphate ester.

29. The process of claim 16, wherein said lubricant comprises a solid lubricating material.

30. The process of claim 29, wherein said solid comprises molybdenum disulfide, graphite, or boron nitride.

31. The process of claim 16, wherein said lubricant comprises a mixture of two or more types of substantially non-aqueous lubricants.

32. The process of claim 16, wherein said lubricant comprises a mixture of a fluorine-containing lubricant and a synthetic oil lubricant.

33. The process of claim 16, wherein said lubricant comprises a polymer of ethylene oxide, propylene oxide, methoxy polyethylene glycol or an oxyethylene alcohol.

34. The process of claim 16, wherein said lubricant is substantially water-soluble, water-soluble, substantially water-dispersible, or water-dispersible so that it can be removed by an aqueous cleaner.

35. The process of claim 34, wherein the aqueous cleaner is water.

36. The process of claim 16, wherein said container is made from polyethylene terephthalate.

37. The process of claim 16, wherein said container is plastic.

38. The process of claim 16, wherein said container comprises a beverage container.

39. The process of claim 16, wherein said lubricant does not comprise a fluorine-containing polymer.

* * * * *